US005353705A

United States Patent [19]

Lewis et al.

[11] Patent Number: 5,353,705

[45] Date of Patent: Oct. 11, 1994

[54] LITHOGRAPHIC PRINTING MEMBERS HAVING SECONDARY ABLATION LAYERS FOR USE WITH LASER-DISCHARGE IMAGING APPARATUS

[75] Inventors: Thomas E. Lewis, E. Hampstead; Michael T. Nowak, Leominster; Kenneth T. Robichaud, Fitchburg, all of Mass.

[73] Assignee: Presstek, Inc., Hudson, N.H.

[21] Appl. No.: 125,319

[22] Filed: Sep. 22, 1993

Related U.S. Application Data

[63] Continuation-in-part of Ser. No. 62,431, May 13, 1993, Pat. No. 5,339,737, which is a continuation-in-part of Ser. No. 917,481, Jul. 20, 1992, abandoned.

[51] Int. Cl.[5] ..... B41N 1/14

[52] U.S. Cl. ..... 101/453; 101/462

[58] Field of Search ..... 101/453, 454, 455, 457, 101/458, 459, 460, 461, 462, 467; 430/945

[56] References Cited

U.S. PATENT DOCUMENTS

| | | | |
|---|---|---|---|
| 3,506,779 | 4/1970 | Brown et al. | 178/6.6 |
| 3,654,864 | 4/1972 | Ovshinsky | 101/426 |
| 3,664,737 | 5/1972 | Lipp | 355/18 |
| 3,678,852 | 7/1972 | Feinleib et al. | 101/465 |
| 3,745,235 | 7/1973 | Bestenreiner et al. | 178/5.2 R |
| 3,760,175 | 9/1973 | Gibson et al. | 240/1 |
| 3,780,358 | 12/1973 | Thompson | 317/235 |
| 3,803,511 | 4/1974 | Thompson | 331/94.5 |
| 3,832,718 | 8/1974 | Berkowitz et al. | 346/74 |
| 3,836,709 | 9/1974 | Hutchison | 178/6.7 |
| 3,911,376 | 10/1975 | Thompson | 331/94.5 |
| 3,945,318 | 3/1976 | Landsman | 101/467 |
| 3,962,513 | 6/1976 | Eames | 428/323 |
| 3,964,389 | 6/1976 | Peterson | 101/467 |
| 3,985,953 | 10/1976 | Dunkley | 178/6.6 |
| 4,020,762 | 5/1977 | Peterson | 101/467 |
| 4,046,986 | 9/1977 | Barker | 219/121 |
| 4,054,094 | 10/1977 | Caddell et al. | 101/467 |
| 4,060,032 | 11/1977 | Evans | 101/467 |
| 4,063,949 | 12/1977 | Uhlig et al. | 101/467 |
| 4,132,168 | 1/1979 | Peterson | 101/471 |
| 4,149,798 | 4/1979 | McGowan et al. | 355/8 |
| 4,212,672 | 7/1980 | Mihara et al. | 430/494 |
| 4,245,003 | 1/1981 | Oransky et al. | 428/323 |
| 4,247,611 | 1/1981 | Sander et al. | 430/286 |
| 4,334,003 | 6/1982 | Jones | 430/156 |
| 4,347,785 | 9/1982 | Chase et al. | 101/1 |
| 4,390,610 | 6/1983 | Bowden et al. | 430/58 |
| 4,395,946 | 8/1983 | Price | 101/152 |
| 4,458,994 | 7/1984 | Jain et al. | 354/4 |
| 4,460,831 | 7/1984 | Oettinger et al. | 250/494.2 |
| 4,492,750 | 1/1985 | Law et al. | 430/494 |
| 4,501,811 | 2/1985 | Saikawa et al. | 430/204 |

(List continued on next page.)

FOREIGN PATENT DOCUMENTS

| | | |
|---|---|---|
| 3714157 | 11/1988 | Fed. Rep. of Germany . |
| 3-197190 | 8/1991 | Japan . |
| 3-197191 | 8/1991 | Japan . |
| 3-197192 | 8/1991 | Japan . |
| WO9207716 | 5/1992 | PCT Int'l Appl. . |

OTHER PUBLICATIONS

*Molecular And Dynamic Studies On Lase Abalation of Doped Polymer Systems,* 17 Polymer News (1991).

E. B. Cargill et al., *A Report On Polaroid's New Dry Imaging Technology For Generating 8×10 Radiographic Films* (Jan. 1993).

E. B. Cargill et al., *A Report On The Image Quality Characteristics Of The Polaroid Helios Laser System* (Oct. 1992).

*Primary Examiner*—Edgar S. Burr
*Assistant Examiner*—Stephen R. Funk
*Attorney, Agent, or Firm*—Cesari and McKenna

[57] ABSTRACT

Lithographic printing plates suitable for imaging by means of laser devices. Laser output ablates one or more plate layers, resulting in an imagewise pattern of features on the plate. The image features exhibit an affinity for ink or an ink-abhesive fluid that differs from that of unexposed areas. The plates also include a secondary ablation layer that ablates only partially, and in a controlled fashion, as a result of destruction of overlying layers.

18 Claims, 1 Drawing Sheet

U.S. PATENT DOCUMENTS 4,504,141 3/1985 Yamakoshi ..... 355/77
4,550,061 10/1985 Sachdev et al. ..... 428/461
4,588,674 5/1986 Stewart et al. ..... 430/273
4,592,977 6/1986 Naganuma et al. ..... 430/18
4,599,295 7/1986 Kondo et al. ..... 430/156
4,622,179 11/1986 Eda ..... 540/139
4,628,813 12/1986 Hasegawa et al. ..... 101/116
4,675,357 6/1987 Welch ..... 524/406
4,711,834 12/1987 Butters et al. ..... 430/201
4,729,310 3/1988 Love, III ..... 101/157
4,731,317 3/1988 Fromson et al. ..... 430/159
4,743,091 5/1988 Gelbart ..... 350/252
4,749,840 6/1988 Piwczyk ..... 219/121
4,784,933 11/1988 Kanada et al. ..... 430/204
4,788,514 11/1988 Fox ..... 332/7.51
4,861,698 8/1989 Hiruma et al. ..... 101/467
4,872,189 10/1989 Frankel et al. ..... 378/119
4,877,480 10/1989 Das ..... 156/635
4,881,231 11/1989 Jain ..... 372/32
4,917,454 4/1990 Feder ..... 250/227.23
4,918,304 4/1990 Gordon ..... 250/227.26
4,948,699 8/1990 Nishinoiri et al. ..... 430/204
4,975,728 12/1990 Gordon ..... 355/1
4,975,729 12/1990 Gordon ..... 355/1
5,011,261 4/1991 Gordon ..... 350/96.25
5,015,064 5/1991 Detig et al. ..... 350/96.24
5,082,799 1/1992 Homstrom et al. ..... 437/129
5,093,147 3/1992 Andrus et al. ..... 427/7
5,093,832 3/1992 Bethune et al. ..... 372/21
5,095,491 3/1992 Kozlovsky et al. ..... 372/94
5,101,414 3/1992 Schilling et al. ..... 372/50
5,102,758 4/1992 Kazmaier et al. ..... 430/58
5,107,509 4/1992 Esterowitz et al. ..... 372/20
5,156,938 10/1992 Foley et al. ..... 430/200
5,171,650 12/1992 Ellis et al. ..... 430/20

LITHOGRAPHIC PRINTING MEMBERS HAVING SECONDARY ABLATION LAYERS FOR USE WITH LASER-DISCHARGE IMAGING APPARATUS

RELATED APPLICATION

This is a continuation-in-part of Ser. No. 08/062,431, filed on May 13, 1993, now U.S. Pat. No. 5,339,737, which is itself a continuation-in-part of Ser. No. 07/917,481, filed on Jul. 20, 1992 now abandoned.

BACKGROUND OF THE INVENTION

A. Field of the Invention

The present invention relates to digital printing apparatus and methods, and more particularly to lithographic printing plate constructions that may be imaged on- or off-press using digitally controlled laser output.

B. Description of the Related Art

Traditional techniques of introducing a printed image onto a recording material include letterpress printing, gravure printing and offset lithography. All of these printing methods require a plate, usually loaded onto a plate cylinder of a rotary press for efficiency, to transfer ink in the pattern represented on the plate in the form of raised areas that accept ink and transfer it onto the recording medium by impression. Gravure printing cylinders, in contrast, contain series of wells or indentations that accept ink for deposit onto the recording medium; excess ink must be removed from the cylinder by a doctor blade or similar device prior to contact between the cylinder and the recording medium.

In the case of offset lithography, the image is present on a plate or mat as a pattern of ink-accepting (oleophilic) and ink-repellent (oleophobic) surface areas. In a dry printing system, the plate is simply inked and the image transferred onto a recording material; the plate first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

In a wet lithographic system, the non-image areas are hydrophilic, and the necessary ink-repellency is provided by an initial application of a dampening (or "fountain") solution to the plate prior to inking. The ink-repellent fountain solution prevents ink from adhering to the non-image areas, but does not affect the oleophilic character of the image areas.

If a press is to print in more than one color, a separate printing plate corresponding to each color is required, each such plate usually being made photographically as described below. In addition to preparing the appropriate plates for the different colors, the operator must mount the plates properly on the plate cylinders of the press, and coordinate the positions of the cylinders so that the color components printed by the different cylinders will be in register on the printed copies. Each set of cylinders associated with a particular color on a press is usually referred to as a printing station.

In most conventional presses, the printing stations are arranged in a straight or "in-line" configuration. Each such station typically includes an impression cylinder, a blanket cylinder, a plate cylinder and the necessary ink (and, in wet systems, dampening) assemblies. The recording material is transferred among the print stations sequentially, each station applying a different ink color to the material to produce a composite multi-color image. Another configuration, described in U.S. Pat. No. 4,936,211 (co-owned with the present application and hereby incorporated by reference), relies on a central impression cylinder that carries a sheet of recording material past each print station, eliminating the need for mechanical transfer of the medium to each print station.

With either type of press, the recording medium can be supplied to the print stations in the form of cut sheets or a continuous "web" of material. The number of print stations on a press depends on the type of document to be printed. For mass copying of text or simple monochrome line-art, a single print station may suffice. To achieve full tonal rendition of more complex monochrome images, it is customary to employ a "duotone" approach, in which two stations apply different densities of the same color or shade. Full-color presses apply ink according to a selected color model, the most common being based on cyan, magenta, yellow and black (the "CMYK" model). Accordingly, the CMYK model requires a minimum of four print stations; more may be required if a particular color is to be emphasized. The press may contain another station to apply spot lacquer to various portions of the printed document, and may also feature one or more "perfecting" assemblies that invert the recording medium to obtain two-sided printing.

The plates for an offset press are usually produced photographically. To prepare a wet plate using a typical negative-working subtractive process, the original document is photographed to produce a photographic negative. This negative is placed on an aluminum plate having a water-receptive oxide surface coated with a photopolymer. Upon exposure to light or other radiation through the negative, the areas of the coating that received radiation (corresponding to the dark or printed areas of the original) cure to a durable oleophilic state. The plate is then subjected to a developing process that removes the uncured areas of the coating (i.e., those which did not receive radiation, corresponding to the non-image or background areas of the original), exposing the hydrophilic surface of the aluminum plate.

A similar photographic process is used to create dry plates, which typically include an oleophobic (e.g., silicone) surface layer coated onto a photosensitive layer, which is itself coated onto a substrate of suitable stability (e.g., an aluminum sheet). Upon exposure to actinic radiation, the photosensitive layer cures to a state that destroys its bonding to the surface layer. After exposure, a treatment is applied to deactivate the photoresponse of the photosensitive layer in unexposed areas and to further improve anchorage of the surface layer to these areas. Immersion of the exposed plate in developer results in dissolution and removal of the surface layer at those portions of the plate surface that have received radiation, thereby exposing the ink-receptive, cured photosensitive layer.

Photographic platemaking processes tend to be time-consuming and require facilities and equipment adequate to support the necessary chemistry. To circumvent these shortcomings, practitioners have developed a number of electronic alternatives to plate imaging, some of which can be utilized on-press. With these systems, digitally controlled devices alter the ink-receptivity of blank plates in a pattern representative of the image to be printed. Such imaging devices include sources of electromagnetic-radiation pulses, produced by one or more laser or non-laser sources, that create chemical changes on plate blanks (thereby eliminating the need for a photographic negative); ink-jet equipment that directly deposits ink-repellent or ink-accepting spots on plate blanks; and spark-discharge equipment, in which an electrode in contact with or spaced close to a plate blank produces electrical sparks to physically alter the topology of the plate blank, thereby producing "dots" which collectively form a desired image (see, e.g., U.S. Pat. No. 4,911,075, co-owned with the present application and hereby incorporated by reference).

Because of the ready availability of laser equipment and their amenability to digital control, significant effort has been devoted to the development of laser-based imaging systems. Early examples utilized lasers to etch away material from a plate blank to form an intaglio or letterpress pattern. See, e.g., U.S. Pat. Nos. 3,506,779; 4,347,785. This approach was later extended to production of lithographic plates, e.g., by removal of a hydrophilic surface to reveal an oleophilic underlayer. See, e.g., U.S. Pat. No. 4,054,094. These systems generally require high-power lasers, which are expensive and slow.

A second approach to laser imaging involves the use of laser-ablation-transfer materials. See, e.g., U.S. Pat. Nos. 3,945,318; 3,962,513; 3,964,389; 4,395,946; 5,156,938 and 5,171,650. With these systems, a polymer sheet transparent to the radiation emitted by the laser is coated with a transferable material. During operation the transfer side of this construction is brought into contact with an acceptor sheet, and the transfer material is selectively irradiated through the transparent layer. Irradiation causes the transfer material to adhere preferentially to the acceptor sheet. The transfer and acceptor materials exhibit different affinities for fountain solution and/or ink, so that removal of the transparent layer together with unirradiated transfer material leaves a suitably imaged, finished plate. Typically, the transfer material is oleophilic and the acceptor material hydrophilic. Plates produced with transfer-type systems tend to exhibit short useful lifetimes due to the limited amount of material that can effectively be transferred. In addition, because the transfer process involves melting and resolidification of material, image quality tends to be visibly poorer than that obtainable with other methods.

Finally, lasers can be used to expose a photosensitive blank for traditional chemical processing. See, e.g., U.S. Pat. Nos. 3,506,779; 4,020,762. In an alternative to this approach, a laser has been employed to selectively remove, in an imagewise pattern, an opaque coating that overlies a photosensitive plate blank. The plate is then exposed to a source of radiation, with the unremoved material acting as a mask that prevents radiation from reaching underlying portions of the plate. See, e.g., U.S. Pat. No. 4,132,168. Either of these imaging techniques requires the cumbersome chemical processing associated with traditional, non-digital platemaking.

The parent to the present application (Ser. No. 08/062,431, now U.S. Pat. No. 5,339,737, the entire disclosure of which is hereby incorporated by reference) discloses a variety of plate-blank constructions, enabling production of "wet" plates that utilize fountain solution during printing or "dry" plates to which ink is applied directly. In particular, the '737 patent describes a first embodiment that includes a first layer and a substrate underlying the first layer, the substrate being characterized by efficient absorption of infrared ("IR") radiation, and the first layer and substrate having different affinities for ink (in a dry-plate construction) or a fluid that repels ink (in a wet-plate construction). Laser radiation is absorbed by the substrate, and ablates the substrate surface in contact with the first layer; this action disrupts the anchorage of the substrate to the overlying first layer, which is then easily removed at the points of exposure. The result of removal is an image spot whose affinity for the ink or ink-repellent fluid differs from that of the unexposed first layer. The '737 patent also discloses a variation of this embodiment in which the first layer, rather than the substrate, absorbs IR radiation. In this case the substrate serves a support function and provides contrasting affinity characteristics.

In a second embodiment disclosed in the '737 patent, the first, topmost layer is chosen for its affinity for (or repulsion of) ink or an ink-repellent fluid. Underlying the first layer is a second layer, which absorbs IR radiation. A strong, stable substrate underlies the second layer, and is characterized by an affinity for (or repulsion of) ink or an ink-repellent fluid opposite to that of the first layer. Exposure of the plate to a laser pulse ablates the absorbing second layer, weakening the topmost layer as well. As a result of ablation of the second layer, the weakened surface layer is no longer anchored to an underlying layer, and is easily removed.

Finally, the '737 patent describes variation of the foregoing embodiments by addition, beneath the absorbing layer, of an additional layer that reflects IR radiation. This additional layer reflects any radiation that penetrates the absorbing layer back through that layer, so that the effective flux through the absorbing layer is significantly increased.

All of these constructions, while useful and effective, generally require removal of the disrupted—but still remaining—topmost layer (and any debris remaining from destruction of the absorptive second layer) in a post-imaging cleaning step. Depending on the materials chosen for the substrate and topmost layers, imaging exposure can fuse these two layers, rendering the latter especially resistant to removal. Furthermore, in some constructions, debris from one or more ablated layers can condense or otherwise deposit on the topmost unablated layer (e.g., the substrate ), resulting in the need for strenuous cleaning that can prove both time-consuming and cumbersome. Finally, we have also in some instances observed charring of the topmost unablated layer, an effect that can degrade printing performance by roughening this layer and thereby interfering with its interaction with printing fluids (an effect also observed when post-imaging cleaning fails to remove a sufficient proportion of the accumulated debris).

DESCRIPTION OF THE INVENTION

Brief Summary of the Invention

The present invention enables rapid, efficient production of lithographic printing plates using laser equipment, and the approach contemplated herein may be applied to any of a variety of laser sources that emit in various regions of the electromagnetic spectrum. The problems of debris buildup and/or charring, common to numerous laser-imaging processes, are ameliorated by introduction of a secondary ablation layer into the plate constructions. As used herein, the term "plate" refers to any type of printing member or surface capable of recording an image defined by regions exhibiting differential affinities for ink and/or fountain solution; suitable configurations include the traditional planar or curved lithographic plates that are mounted on the plate cylinder of a printing press, but can also include cylinders (e.g., the roll surface of a plate cylinder), an endless belt, or other arrangement.

All constructions of the present invention utilize materials that enhance the ablative efficiency of the laser beam. Substances that do not heat rapidly or absorb significant amounts of radiation will not ablate unless they are irradiated for relatively long intervals and/or receive high-power pulses.

In particular, the printing media of the present invention are based on a cooperative construction that includes a "secondary" ablation layer. This layer ablates, or decomposes into gases and volatile fragments, in response to heat generated by ablation of one or more overlying layers. If transmitted directly to the plate substrate, that heat might char that layer. The secondary ablation layer preferably does not interact with the laser radiation and, to facilitate reverse-side imaging as described in copending application Ser. No. 08/061,701 (commonly owned with the present application and hereby incorporated by reference), is desirably transparent (or substantially so) to such radiation.

In a typical construction, a radiation-absorbing layer underlies a surface coating chosen for its interaction with ink and/or fountain solution. The secondary ablation layer is located beneath the absorbing layer, and may be anchored to a substrate having superior mechanical properties. It may be preferable in some instances to introduce an additional layer between the secondary ablation layer and the substrate to enhance adhesion therebetween, as more fully described below.

Alternatively, the basic plate construction can consist of substrate that supports a radiation-absorptive layer (which performs the functions of the surface and absorbing layers in the constructions discussed above), the two layers differing in their affinities for ink and/or fountain solution. In this case, the secondary ablation layer is located between the substrate and the radiation-absorptive layer.

The secondary ablation layer should ablate "cleanly'-'—that is, exhibit sufficient thermal instability as to decompose rapidly and uniformly upon application of heat, evolving primarily gaseous decomposition products. Preferred materials undergo substantially complete thermal decomposition (or pyrolysis) with limited melting or formation of solid decomposition products, and are typically based on chemical structures that readily undergo, upon exposure to sufficient thermal energy, eliminations (e.g., decarboxylations) and rearrangements producing volatile products.

The secondary ablation layer is applied at a thickness sufficient to ablate only partially in response to the heat produced by ablation of the one or more overlying layers. Accordingly, the plates of the present invention are properly viewed as cooperative constructions tailored for a particular imaging system, in that the proper thickness of the secondary ablation layer is determined by the degree of absorbance exhibited by the overlying absorbing layer and the ablative responsiveness of that the layer to imaging radiation. For example, ablation of a radiation-absorbing layer can reflect an exothermic process (e.g., exothermic oxidation), resulting in the production of more energy than is delivered by the laser.

Our preferred materials are based on polymethylmethacrylate (PMMA), which may be doped with radiation-absorbing chromophores as described below, although numerous other polymeric materials having the foregoing characteristics provide acceptable performance.

Because they ablate cleanly, secondary ablation layers avoid the uneven topologies associated with charring of the plate substrate; indeed, the secondary ablation layer performs a protective function that shields the substrate from the thermal effects of imaging radiation; this function proves particularly useful in conjunction with metal substrates. Furthermore, the rapid decomposition of the secondary ablation layer evolves a gaseous plume or cloud that discourages accumulation of particulate remnants of overlying layers. One can even eliminate the need for post-imaging cleaning of the finished plate by using secondary ablation layers of sufficient thickness (and/or relative unresponsiveness to thermal stress) to permit the use of high-power imaging lasers whose output is strong enough to fully remove all overlying layers.

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENTS

IMAGING APPARATUS

Figure 1:
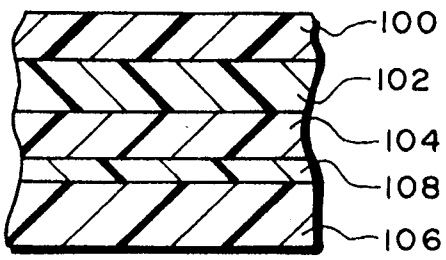
FIG. 1 is an enlarged sectional view of a lithographic plate having a top layer, a radiation-absorptive layer, and a secondary ablation layer mounted to a substrate by means of an adhesion-promoting layer.

Imaging apparatus suitable for use in conjunction with the present printing members includes at least one laser device that emits in the region of maximum plate responsiveness, i.e., whose $lambda_{max}$ closely approximates the wavelength region where the plate absorbs most strongly. Specifications for lasers that emit in the near-IR region are fully described in the '737 patent; lasers emitting in other regions of the electromagnetic spectrum are well-known to those skilled in the art.

Suitable imaging configurations are also set forth in detail in the '737 patent. Briefly, laser output can be provided directly to the plate surface via lenses or other beam-guiding components, or transmitted to the surface of a blank printing plate from a remotely sited laser using a fiber-optic cable. A controller and associated positioning hardware maintains the beam output at a precise orientation with respect to the plate surface, scans the output over the surface, and activates the laser at positions adjacent selected points or areas of the plate. The controller responds to incoming image signals corresponding to the original document or picture being copied onto the plate to produce a precise negative or positive image of that original. The image signals are stored as a bitmap data file on a computer. Such files may be generated by a raster image processor (RIP) or other suitable means. For example, a RIP can accept input data in page-description language, which defines all of the features required to be transferred onto the printing plate, or as a combination of page-description language and one or more image data files. The bitmaps are constructed to define the hue of the color as well as screen frequencies and angles.

The imaging apparatus can operate on its own, functioning solely as a platemaker, or can be incorporated directly into a lithographic printing press. In the latter case, printing may commence immediately after application of the image to a blank plate, thereby reducing press set-up time considerably. The imaging apparatus can be configured as a flatbed recorder or as a drum recorder, with the lithographic plate blank mounted to the interior or exterior cylindrical surface of the drum. Obviously, the exterior drum design is more appropriate to use in situ, on a lithographic press, in which case the print cylinder itself constitutes the drum component of the recorder or plotter.

In the drum configuration, the requisite relative motion between the laser beam and the plate is achieved by rotating the drum (and the plate mounted thereon) about its axis and moving the beam parallel to the rotation axis, thereby scanning the plate circumferentially so the image "grows" in the axial direction. Alternatively, the beam can move parallel to the drum axis and, after each pass across the plate, increment angularly so that the image on the plate "grows" circumferentially. In both cases, after a complete scan by the beam, an image corresponding (positively or negatively) to the original document or picture will have been applied to the surface of the plate.

In the flatbed configuration, the beam is drawn across either axis of the plate, and is indexed along the other axis after each pass. Of course, the requisite relative motion between the beam and the plate may be produced by movement of the plate rather than (or in addition to) movement of the beam.

Regardless of the manner in which the beam is scanned, it is generally preferable (for on-press applications) to employ a plurality of lasers and guide their outputs to a single writing array. The writing array is then indexed, after completion of each pass across or along the plate, a distance determined by the number of beams emanating from the array, and by the desired resolution (i.e., the number of image points per unit length). Off-press applications, which can be designed to accommodate very rapid plate movement (e.g., through use of high-speed motors) and thereby utilize high laser pulse rates, can frequently utilize a single laser as an imaging source.

LITHOGRAPHIC PRINTING PLATES

Refer first to FIG. 1, which illustrates a representative embodiment of a lithographic plate in accordance with the present invention. The plate illustrated in FIG. 1 includes a surface layer 100, a layer 102 capable of absorbing imaging radiation, a secondary ablation layer 104, and a substrate 106. Secondary ablation layer 104 may be adhered to substrate 106 by means of an adhesion-promoting layer 108. These layers will now be described in detail.

a. Surface Layer 100

Layers 100 and 104 exhibit opposite affinities for ink or an ink-repellent fluid. In one version of this plate, surface layer 100 is a silicone polymer that repels ink, while secondary ablation layer 104 is oleophilic polyester. In a second, wet-plate version, surface layer 100 is a hydrophilic material, while secondary ablation layer 104 is both oleophilic and hydrophobic.

Examples of suitable materials for surface layer 100 are set forth below. In general, silicone materials of the type described in U.S. Pat. No. 5,212,048 (the entire disclosure of which is hereby incorporated by reference) provide advantageous performance for dry plates; materials based on polyvinyl alcohol (e.g., the Airvol 125 material supplied by Air Products, Allentown, Pa. and as described in the '431 application) provide a satisfactory surface material for wet plates.

EXAMPLE 1

As a specific example, the following silicone coating provides advantageous performance in a positive-working dry plate construction:

| Component | Parts |
|---|---|
| PS-445 | 22.56 |
| PC-072 | .70 |
| VM&P Naphtha | 76.70 |
| Syl-Off 7367 | .04 |

(These components are described in greater detail, and their sources indicated, in U.S. Pat. No. 5,188,032 (the entire disclosure of which is hereby incorporated by reference) and the '048 patent, as well as U.S. Pat. No. 5,310,869, also hereby incorporated by reference; these documents describe numerous other silicone formulations useful as the material of an oleophobic layer 100.)

b. Radiation-Absorptive Layer 102

Layer 102 absorbs energy from incident imaging radiation and, in response, fully ablates. It can consist of a polymeric system that intrinsically absorbs in the laser's region of maximum power output, or a polymeric coating into which radiation-absorbing components have been dispersed or dissolved.

For example, we have found that many of the surface layers described in U.S. Pat. Nos. 5,109,771 5,165,345, and 5,249,525 (all commonly owned with the present application and all of which are hereby incorporated by reference), which contain filler particles that assist the spark-imaging process, can also serve as an IR-absorbing surface layer. In fact, the only filler pigments totally unsuitable as IR absorbers are those whose surface morphologies result in highly reflective surfaces. Thus, white particles such as $TiO_2$ and ZnO, and off-white compounds such as $SnO_2$, owe their light shadings to efficient reflection of incident light, and prove unsuitable for use.

Among the particles suitable as IR absorbers, direct correlation does not exist between performance in the present environment and the degree of usefulness as a spark-discharge plate filler. Indeed, a number of compounds of limited advantage to spark-discharge imaging absorb IR radiation quite well. Semiconductive compounds appear to exhibit, as a class, the best performance characteristics for the present invention. Without being bound to any particular theory or mechanism, we believe that electrons energetically located in and adjacent to conducting bands are readily promoted into and within the band by absorbing IR radiation, a mechanism in agreement with the known tendency of semiconductors to exhibit increased conductivity upon heating due to thermal promotion of electrons into conducting bands.

Currently, it appears that metal borides, carbides, nitrides, carbonitrides, bronze-structured oxides, and oxides structurally related to the bronze family but lacking the A component (e.g., $WO_{2.9}$) perform best.

Black pigments, such as carbon black, absorb adequately over substantially all of the visible region, and can be utilized in conjunction with visible-spectrum lasers.

EXAMPLE 2

As an example, a nitrocellulose layer containing carbon black as an absorbing pigment is produced from the following base composition:

| Component | Parts |
|---|---|
| Nitrocellulose | 14 |
| Cymel 303 | 2 |
| 2-Butanone (methyl ethyl ketone) | 236 |

The nitrocellulose utilized is the 30% isopropanol wet 5–6 Sec RS Nitrocellulose supplied by Aqualon Co., Wilmington, Del. Cymel 303 is hexamethoxymethylmelamine, supplied by American Cyanamid Corp.

Equal parts of carbon black (specifically, the Vulcan XC-72 conductive carbon black pigment supplied by the Special Blacks Division of Cabot Corp., Waltham, Mass.) and NaCure 2530, an amine-blocked p-toluenesulfonic acid solution in an isopropanol/methanol blend which is supplied by King Industries, Norwalk, Conn., are combined with the base nitrocellulose composition in proportions of 4:4:252. The resulting composition may be applied to a polyester substrate using a wire-wound rod. In particular, after drying to remove the volatile solvent(s) and curing (1 min at 300° F. in a lab convection oven performed both functions), the coating is preferably deposited at 1 g/m$^2$.

Alternatively, organic chromophores can be used in lieu of pigments. Such materials are desirably soluble or easily dispersed in the material which, when cured, functions as layer 100. IR-absorptive dyes include a variety of phthalocyanine and naphthalocyanine compounds, while chromophores that absorb in the ultraviolet region include benzoin, pyrene, benzophenone, acridine, 4-aminobenzoylhydrazide, 2-(2'-hydroxy-3',5'-diisopentylphenyl)benzotriazole, rhodamine 6G, tetraphenylporphyrin, hematoporphyrin, ethylcarbazole, and poly(N-vinylcarbazole). Generally, suitable chromophores can be found to accommodate imaging using virtually any practicable type of laser. See, e,g., U.S. Pat. Nos. 5,156,938 and 5,171,650 (the entire disclosures of which are hereby incorporated by reference). The chromophores concentrate laser energy within the absorbing layer and cause its destruction, disrupting and possibly consuming the surface layer as well, and intentionally damaging the secondary ablation layer.

Figure 2:
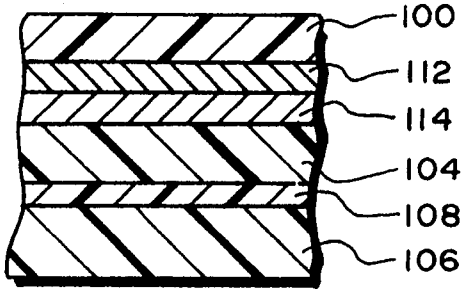
FIG. 2 is an enlarged sectional view of a lithographic plate having a top layer, a radiation-absorptive composite including TiO and aluminium layers, and a secondary ablation layer mounted to a substrate by means of an adhesion-promoting layer.

Absorbing layer 102 can also be a composite of more than one layer. For example, FIG. 2 illustrates an alternative embodiment wherein absorbing layer 102 has been replaced with a bilayer construction consisting of a thin layer 112 of TiO, preferably having a thickness of 25–700 Å, which resides atop a thin layer 114 of aluminum preferably having a thickness of approximately 500 Å. These layers are anchored to a secondary ablation layer 104. This embodiment can be straightforwardly manufactured by coating the secondary ablation layer onto a substrate, electron-beam evaporating an aluminum layer thereon, electron-beam evaporating the TiO layer onto the aluminum layer, and coating the surface layer onto the applied TiO layer. It is also possible to substitute other metals such as chromium, nickel, zinc, copper, or titanium for aluminum, although aluminum is preferred for ease of ablation and favorable environmental and toxicity characteristics.

Figure 3:
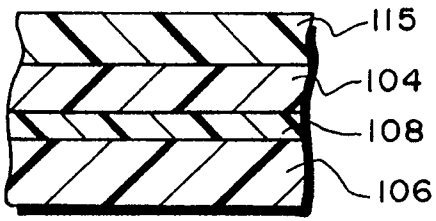
FIG. 3 is an enlarged sectional view of a lithographic plate having a top layer that absorbs laser radiation and a secondary ablation layer mounted to a substrate by means of an adhesion-promoting layer.

Conversely, the function of absorbing layer 102 can be merged with that of surface layer 100 as shown in FIG. 3. The illustrated embodiment includes a surface layer 115 containing a chromophore or a disperson of pigments that absorb radiation in the spectral region of the imaging laser. Pigments that absorb in the near-IR region are discussed above, while IR-absorbing silicone compositions suitable for use in the present context as surface-layer 100 for dry-plate constructions are described in U.S. Pat. No. 5,310,869, commonly owned with the present invention and hereby incorporated by reference.

c. Secondary Ablation Layer 104

As stated above, the secondary ablation layer undergoes rapid and uniform thermal degradation. Polymeric materials that exhibit limited thermal stability, particularly those transparent to imaging radiation (or at least able to transmit such radiation with minimal scattering, refraction and attenuation), are preferred. Useful polymers include (but are not limited to) materials based on PMMA, polycarbonates, polyesters, polyurethanes, polystyrenes, styrene/acrylonitrile polymers, cellulosic ethers and esters, polyacetals, and combinations (e.g., copolymers or terpolymers) of the foregoing.

The secondary ablation layer is applied to a thickness adequate to avoid complete ablation in response to the thermal flux originating in the ablation of absorbing layer 102. Useful thicknesses range from a minimum of 1 micron, with upper limits dictated primarily by economics (e.g., 30 microns or more); a typical working range is 4–10 microns. The following formulations can be utilized on polyester film or aluminum substrates:

EXAMPLES 3–7

| | Example | | | | |
|---|---|---|---|---|---|
| | 3 | 4 | 5 | 6 | 7 |
| Component | Parts | | | | |
| 2-Butanone | 65 | 65 | 70 | 81.5 | — |
| Normal Propyl Acetate | 20 | 20 | — | — | — |
| Acryloid B-44 | 10 | 10 | — | — | — |
| Doresco AC2-79A | — | — | 25 | — | — |
| Cargill 72-7289 | — | — | — | 13.5 | — |
| Cymel 303 | 4 | 4 | 4 | 4 | — |
| Cycat 4040 | 1 | 1 | 1 | 1 | — |
| 10% $H_3PO_4$ Soln. | — | 2 | — | — | — |
| Deft 03-X-85 A | — | — | — | — | 50 |
| Deft 03-X-85 B | — | — | — | — | 50 |

Acryloid B-44 is an acrylic resin supplied by Rohm & Haas, Philadelphia, Pa. Doresco AC2-79A is a 40%-solids acrylic resin solution in toluene, and is supplied by Dock Resins Corp., Linden, N.J. Cargill 72-7289 is a 75%-solids polyester resin solution in propylene glycol monopropyl ether supplied by Cargill Inc., Carpentersville, Ill. Cycat 4040 is a 40%-solids paratoluene sulfonic acid solution in isopropanol supplied by American Cyanamid Co., Wayne, N.J. Deft 03-X-35 A is a 65% polyester resin solution supplied by Deft, Inc., Irvine, Calif., and the 03-X-35 B product is a 50% aliphatic isocyanate resin solution. The solvent of the phosphoric acid solution is 2-butanone.

The composition of Example 3 is well-suited to use on polyester substrates. Example 4 includes a phosphoric acid solution, which promotes adhesion of the secondary ablation layer to an aluminum substrate. The coatings of Examples 5 and 6 can be used either on polyester or metal substrates, while that of Example 7 is best suited to aluminum substrates.

d. Substrate 106 and Adhesion-Promoting Layer 108

Substrate 106 is preferably mechanically strong, durable and flexible, and may be a polymer film, or a paper or metal sheet. Polyester films (in a preferred embodiment, the MYLAR product sold by E. I. duPont de Nemours Co., Wilmington, Del., or, alternatively, the MELINEX product sold by ICI Films, Wilmington, Del.) furnish useful examples. A preferred polyester-film thickness is 0.007 inch, but thinner and thicker versions can be used effectively. Aluminum is a preferred metal substrate. Paper substrates are typically "saturated" with polymerics to impart water resistance, dimensional stability and strength.

For additional strength, it is possible to utilize the approach described in the '032 patent. As discussed in that patent, a metal sheet can be laminated either to the substrate materials described above, or instead can be utilized directly as a substrate and laminated to secondary ablation layer 104. Suitable metals, laminating procedures and preferred dimensions and operating conditions are all described in the '032 patent, and can be straightforwardly applied to the present context without undue experimentation. For example, in the case of aluminum substrates, silanes or industrial proteins (such as the photographic gelatins used in many conventional lithographic dry plates) serve well to promote adhesion to polymeric secondary ablation layers.

Adhesion-promoting layers can also be used in connection with polyester or other film substrates to enhance bonding to secondary ablation layer 104. For example, the CRONAR polyester films marketed by duPont employ polyvinylidene chloride layers overcoated with a gelatin that enhances adhesion.

Figure 4:
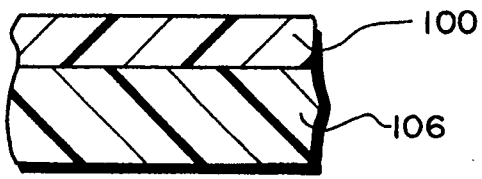
FIG. 4 is an enlarged sectional view of a lithographic plate having a top layer and a secondary ablation layer.

Finally, if secondary ablation layer 104 exhibits adequate mechanical properties, it can be employed in sufficient thickness to itself serve as a substrate, resulting in the construction shown in FIG. 4.

EXAMPLES 8–12

The secondary ablation layers of Examples 3–7 are each coated onto a polyester or metal substrate. The absorbing-layer formulation of Example 2 is then coated over the secondary-ablation layers. Specifically, following addition of the carbon black and dispersion thereof in the base composition, the blocked PTSA catalyst is added, and the resulting mixtures applied to the secondary ablation layer using a wire-wound rod. After drying to remove the volatile solvent(s) and curing (1 min at 300° F. in a lab convection oven performed both functions), the coatings are deposited at 1 g/m$^2$. To this bilayer construction is applied the silicone coating of Example 1 using a wire-wound rod. The coating is dried and cured to produce a uniform deposition of 2 g/m$^2$.

Exposure of the foregoing constructions to the output of an imaging laser at surface layer 100 weakens or ablates that layer, ablates absorbing layer 102, and partially ablates layer 104 in the region of exposure. Alternatively, the constructions can be imaged from the reverse side, i.e., through substrate 106. So long as all layers below absorbing layer 102 are transparent to laser radiation, the beam will continue to perform the functions of ablating absorbing layer 102 and weakening or ablating surface layer 100, while destruction of layer 102 will produce the appropriate controlled damage to layer 104.

Although this "reverse imaging" approach does not require significant additional laser power (energy losses through substantially transparent layers are minimal), it does affect the manner in which the laser beam is focused for imaging. Ordinarily, with surface layer 100 adjacent the laser output, its beam is focused onto the plane of surface layer 100. In the reverse-imaging case, by contrast, the beam must project through all layers underlying absorbing layer 102. Therefore, not only must the beam be focused on the surface of an inner layer (i.e., absorbing layer 102) rather than the outer surface of the construction, but that focus must also accommodate refraction of the beam caused by its transmission through the intervening layers.

Because the plate layer that faces the laser output remains intact during reverse imaging, this approach prevents debris generated by ablation from accumulating in the region between the plate and the laser output. Another advantage of reverse imaging is elimination of the requirement that surface layer 100 efficiently transmit laser radiation. Surface layer 100 can, in fact, be completely opaque to such radiation so long as it remains vulnerable to degradation and subsequent removal.

It will therefore be seen that we have developed a highly versatile imaging system and a variety of plates for use therewith. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A lithographic printing member directly imageable by laser discharge, the member comprising:

a. a topmost first layer; and b. a second layer underlying the first layer, the second layer being characterized by ablative absorption of laser radiation;

c. a third layer underlying the second layer, the third layer:

i. being substantially transparent to the laser radiation;

ii. being ablated only partially in response to ablation of the second layer; and iii. differing from the first layer in its affinity for at least one printing liquid selected from the group consisting of ink and a fluid that repels ink.

2. The member of claim 1 further comprising a mechanically strong, durable and flexible substrate underlying the third layer.

3. The member of claim 2 further comprising an adhesion-promoting layer located between the substrate and the third layer.

4. The member of claim 3 wherein the substrate is polyester, and the substrate and the adhesion-promoting layer together represent a print- or coatability-treated polyester film.

5. The member of claim 3 wherein the substrate is metal and the adhesion-promoting layer is a silane or an industrial protein.

6. The member of claim 2 wherein the substrate is polyester.

7. The member of claim 2 wherein the substrate is metal.

8. The member of claim 7 wherein the metal is aluminum.

9. The member of claim 7 wherein the third layer is a polymethylmethacrylate chemical species.

10. The member of claim 2 wherein the third layer is selected from the group consisting of polymethylmethacrylate, polycarbonates, polyesters, polyurethanes, polystyrenes, styrene/acrylonitrile polymer, cellulosic ethers and esters, polyacetals, and combinations thereof.

11. The member of claim 1 wherein the first layer is oleophobic.

12. The member of claim 11 wherein the first layer is a coating comprising silicone.

13. The member of claim 12 wherein the first layer includes a dispersion of particles that absorb laser radiation.

14. The member of claim 12 wherein the first layer includes a dye that absorbs laser radiation.

15. The member of claim 1 wherein the first layer is wettable by fountain solution.

16. The member of claim 15 wherein the first layer is a polyvinyl alcohol chemical species.

17. The member of claim 1 wherein the third layer is at least 3 but no more than 6 microns thick.

18. The member of claim 1 wherein the second layer is a composite including TiO and aluminum layers.

* * * * *

UNITED STATES PATENT AND TRADEMARK OFFICE

CERTIFICATE OF CORRECTION

PATENT NO. : 5,353,705

DATED : October 11, 1994

INVENTOR(S) : Thomas E. Lewis et al.

It is certified that error appears in the above-identified patent and that said Letters Patent is hereby corrected as shown below:

In col. 8, line 27, change ".70" to --.04--; and
at line 29, change ".04" to --.70--

Signed and Sealed this

Seventh Day of October, 1997

*Attest:*

*Attesting Officer*

BRUCE LEHMAN

*Commissioner of Patents and Trademarks*